US007275327B2

(12) United States Patent
Deien

(10) Patent No.: US 7,275,327 B2
(45) Date of Patent: Oct. 2, 2007

(54) COMPOUND BOW RIFLE SIGHT SYSTEM

(76) Inventor: Melvin Deien, 1004 S. Walnut Rd., Breese, IL (US) 62230

( * ) Notice: Subject to any disclaimer, the term of this patent is extended or adjusted under 35 U.S.C. 154(b) by 0 days.

(21) Appl. No.: 10/648,639

(22) Filed: Aug. 26, 2003

(65) Prior Publication Data

US 2004/0088872 A1 May 13, 2004

Related U.S. Application Data

(63) Continuation-in-part of application No. 10/395,348, filed on Mar. 24, 2003, now abandoned, which is a continuation-in-part of application No. 09/922,289, filed on Aug. 3, 2001, now abandoned.

(51) Int. Cl.
*F41G 1/00* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | | |
|---|---|---|---|---|---|
| 2,642,661 | A | * | 6/1953 | Fredrickson | 33/265 |
| 3,777,380 | A | * | 12/1973 | Theodore | 42/144 |
| 3,945,127 | A | * | 3/1976 | Spencer | 33/265 |
| 4,177,572 | A | * | 12/1979 | Hindes | 33/265 |
| 4,195,414 | A | * | 4/1980 | Robinson | 33/265 |
| 4,220,983 | A | * | 9/1980 | Schroeder | 33/265 |
| 4,325,190 | A | * | 4/1982 | Duerst | 33/265 |
| 4,521,972 | A | * | 6/1985 | Larson | 33/265 |
| 4,620,372 | A | | 11/1986 | Goodrich | |
| 4,915,088 | A | * | 4/1990 | Powers | 33/265 |
| 4,982,503 | A | * | 1/1991 | Land | 33/265 |
| 5,048,193 | A | | 9/1991 | Hacquet | |
| 5,303,479 | A | | 4/1994 | Rudovsky | |
| 5,435,068 | A | * | 7/1995 | Thames et al. | 33/265 |
| 5,579,752 | A | * | 12/1996 | Nelson et al. | 33/265 |
| 5,619,801 | A | * | 4/1997 | Slates | 33/265 |
| 5,630,279 | A | * | 5/1997 | Slates | 33/265 |
| 5,634,278 | A | * | 6/1997 | London | 33/265 |
| 5,735,053 | A | * | 4/1998 | McGunigal | 33/265 |

(Continued)

*Primary Examiner*—G. Bradley Bennett
*Assistant Examiner*—Travis Reis
(74) *Attorney, Agent, or Firm*—Polster, Leider, Woodruff & Lucchesi, L.C.

(57) ABSTRACT

A bow sight system includes a bow sight assembly adjustably mounted to a base plate. The bow sight can include a conventional forward sight, such as a pin sight and a V shaped rear sight. Sighting through the V shaped rear sight groove will allow the archer to see the forward sight if the bow and archer are in proper alignment. A misalignment will cause the groove to obscure the archer's view of the forward sight preventing a misaligned shot. Unlike prior art peep sights, the V groove rear sight allows the archer to have an almost unlimited view of the target field such that the archer can quickly acquire a target. Illuminated alignment marks positioned on either side of the V groove ease the archer's ability to aim in low light conditions. The rear sight can also obscure unused pins of a multiple pin front sight and can also give an indication of target distance based on the number of pins of a multiple pin system visible. The rear sight can be retrofit to an existing bow with a forward sight or can be original equipment on a new bow.

23 Claims, 11 Drawing Sheets

U.S. PATENT DOCUMENTS 5,802,726 A 9/1998 Trosper
5,836,294 A * 11/1998 Merritt ..... 33/265
6,026,799 A 2/2000 Wiseby et al.
6,035,539 A * 3/2000 Hollenbach et al. ..... 42/132
D423,627 S 4/2000 Simpson
2002/0017027 A1* 2/2002 Beshires ..... 33/265

* cited by examiner

COMPOUND BOW RIFLE SIGHT SYSTEM

CROSS REFERENCE TO RELATED APPLICATION

This application is a continuation-in part of application Ser. No. 10/395,348 filed Mar. 24, 2003 now abandoned which was a continuation-in-part of application Ser. No. 09/922,289, filed Aug. 3, 2001 and now abandoned.

BACKGROUND OF THE INVENTION

The present invention relates to bow sights and more particularly to a new compound bow rifle sight system which eliminates the need for a peep sight on a bow. The sight aids the archer in maintaining a consistent body form for accuracy which is crucial to the archer. The sight of the invention is designed to be used in conjunction with a front mounted sight, such as a pin sight, which is used in aiming of a bow and an arrow to be fired by the bow at a target.

DESCRIPTION OF THE PRIOR ART

The use of various bow sighting and aiming systems is generally known in the prior art, as evidenced by the sighting systems disclosed in U.S. Pat. Nos. 5,303,479; 4,620,372; 5,048,193; 5,802,726; 6,026,799 and U.S. Des. Pat. No. 423,627.

Known sight devices, such as pin sights, are mounted forward of the bow and away from the user of the bow when the bow is being held in use by an archer. The known pin sights require a peep sight that is mounted in the bow string to the rear of the bow so that the peep sight is carried by the string and is generally positioned between the pin sight and the user. The combination of the bow mounted pin sight and the string mounted peep sight is intended to produce an accurate aiming of the arrow toward the distant target. In use of the prior art the archer draws back the string of the bow to a set point that the archer is comfortable with, the peep sight should then be close to the eye of the archer and oriented so that the pin sights are visible through a hole in the peep sight. A string line fixed to the bow is often used to properly orient the peep sight.

The use of a peep sight with or without a pin sight has a number of drawbacks. The movable peep sight defines a small hole for the archer to peer through in aligning a shot. One problem with peep sights is that the material surrounding the peep sight hole will obscure the view of the archer. The peep sights commonly in use give the archer about a 10 degree diameter field of view, anything outside this circle of view is obscured. In low light conditions it can be difficult to locate a target through the peep sight. Because the peep sight is so close to the archer's eye it is not possible to see any peep sight structure that would aid the archer in alignment, the archer's eye is focused at 10 to 40 yards where the target is. So instead of having something like cross hairs to align with the correct pin, the archer just has 3 or 4 pins floating in a hazily defined 10 degree circle. The archer then attempts to center a pin in the 10 degree circle with the pin over the target. Good archers do this successfully but it takes time to acquire the target and any bow hunter will tell about the buck that got away while the archer was attempting to 'get a bead' on the target buck. It is also very easy to get a pin on a target and miss the shot because of misalignment of the archer's head and eye relative to the peep sight or because the bow, bow string or peep sight are misaligned. Commonly, the archers eye can be left, right, high or below the center of the peep sight, the archer can sight in the bow with a pin on the target but the shot for example will go left because the archer's eye is slightly right of center of the peep.

As can be seen there is a need for a bow sight that will not have all the problems associated with the prior art. Specifically there is a need for an improved bow sight that will eliminate the alignment and field of view problems associated with the peep sight.

SUMMARY OF THE INVENTION

In view of the foregoing disadvantages inherent in the known types of bow sights now present in the prior art, the present invention provides a new compound bow rifle sight system for replacing the string mounted peep sight on the bow.

The present invention is a bow sight system that includes a bow sight assembly comprising a base plate with a longitudinal axis for mounting on the bow, and a sight assembly having a sight groove which is preferably a V-shaped notch. The sight assembly is mounted on the base plate so that the sighting assembly is adjustably movable along an axis that is substantially perpendicular to the base plate to adjust the position of the sight groove of the sighting assembly in a horizontal direction, and is adjustably movable in a plane that is substantially perpendicular to the longitudinal axis of the base plate to adjust the sight groove in a vertical direction. The system may include a pin sight assembly mounted in a position forward of the bow.

There has been thus outlined, rather broadly, the more important features of the invention in order that the detailed description thereof that follows may be better understood, and in order that the present contribution to the art may be better appreciated. There are additional features of the invention that will be described hereinafter and which will from the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new compound bow rifle sight system for aiding in the aiming of a bow.

It is a further object of the present invention to provide a compound bow sight that will correct bow torque and misalignment and allow the archer to maintain the same consistent body form time after time, which is crucial in accurate aiming of the bow.

Yet another object of the present invention is to provide a new compound bow rifle sight system which includes a bow sight assembly comprising a base plate with a longitudinal axis for mounting on the bow, and a sighting assembly having a sight groove which can be a V-shaped notch. The sighting assembly is mounted on the base plate so that the sighting assembly is adjustably movable along an axis that is substantially perpendicular to the base plate to adjust the position of the sight groove in a horizontal direction and is mounted on the base plate so that the sighting assembly can be adjustably movable in a plane that is oriented substantially perpendicular to the longitudinal axis of the base plate to adjust the position of the sighting assembly in a vertical direction. The system may include a bow and the bow sight assembly is mounted in a position rearward of the bow. The system may include a pin sight assembly mounted in a position forward of the bow.

Still yet another object of the present invention is to provide a new compound bow rifle sight system that can be retrofit to an existing bow to replace the peep sight previously used thereon and which may be used in combination with virtually any type of forward mounted sight assembly including pin sights.

Yet another object of the present invention is to provide a new compound bow rifle sight system using an adjustably sighting groove and a pin sight in combination. The system providing a thickness of the sighting V groove such that a misalignment of the archer or bow will cause the sighting groove to obscure the pin from view thus preventing an errant shot.

It is still another object of the present invention to provide a sighting groove that will provide a wide field of view while also providing the archer with reference points including a groove and alignment points to allow for accurate repeatable aiming of the bow. While providing a wide field of view the present invention does obscure unused pins to provide a less cluttered field of view for the archer allowing a more rapid acquisition of the target.

It is also an object of the present invention to provide a targeting system that will obscure unused pins while at the same time providing an indication of target distance by the number of pins that are visible.

These and other objects of the present invention will become more clear in the following detailed description of the invention with reference to the drawings.

DESCRIPTION OF THE PREFERRED EMBODIMENTS

Figure 1:
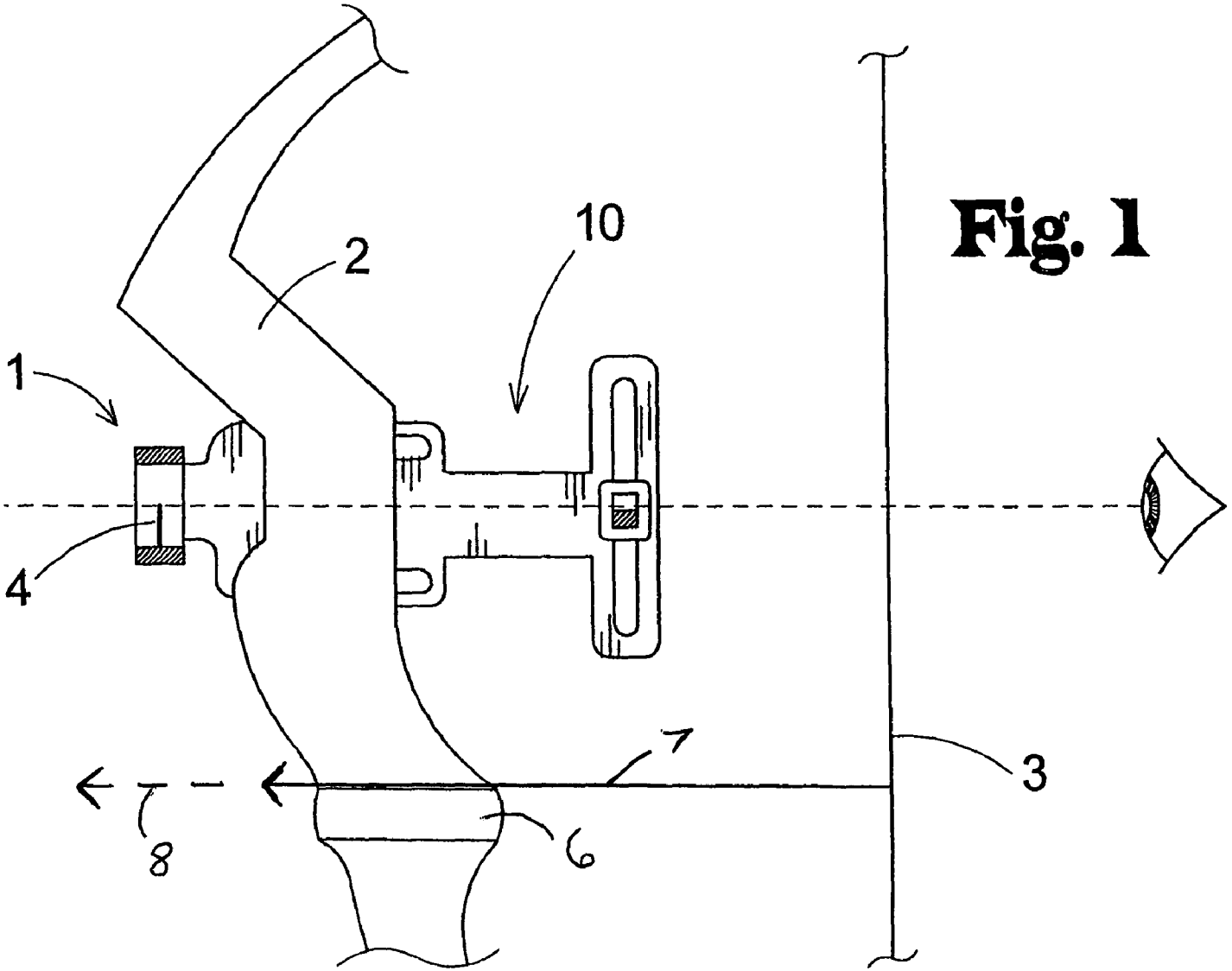
FIG. 1 is a side view of the compound bow rifle sight mounted on a bow.
Figure 2:
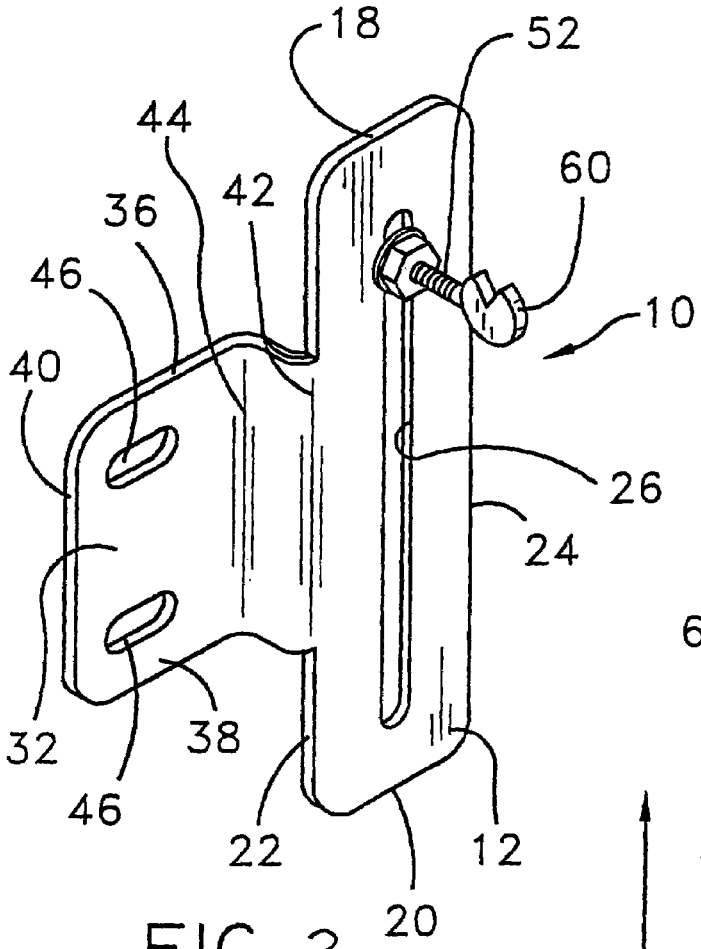
FIG. 2 is a perspective view of a first embodiment of the present invention.
Figure 3:
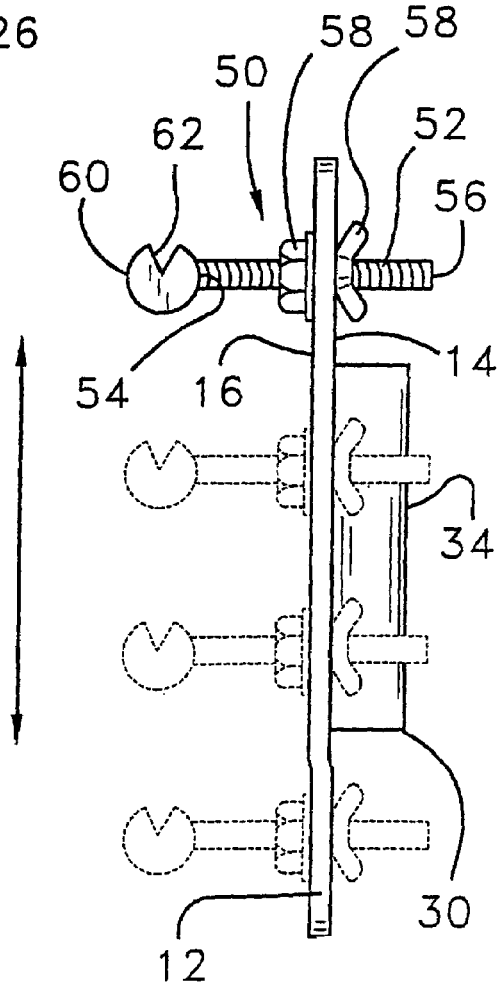
FIG. 3 is a front view of the first embodiment.
Figure 4:
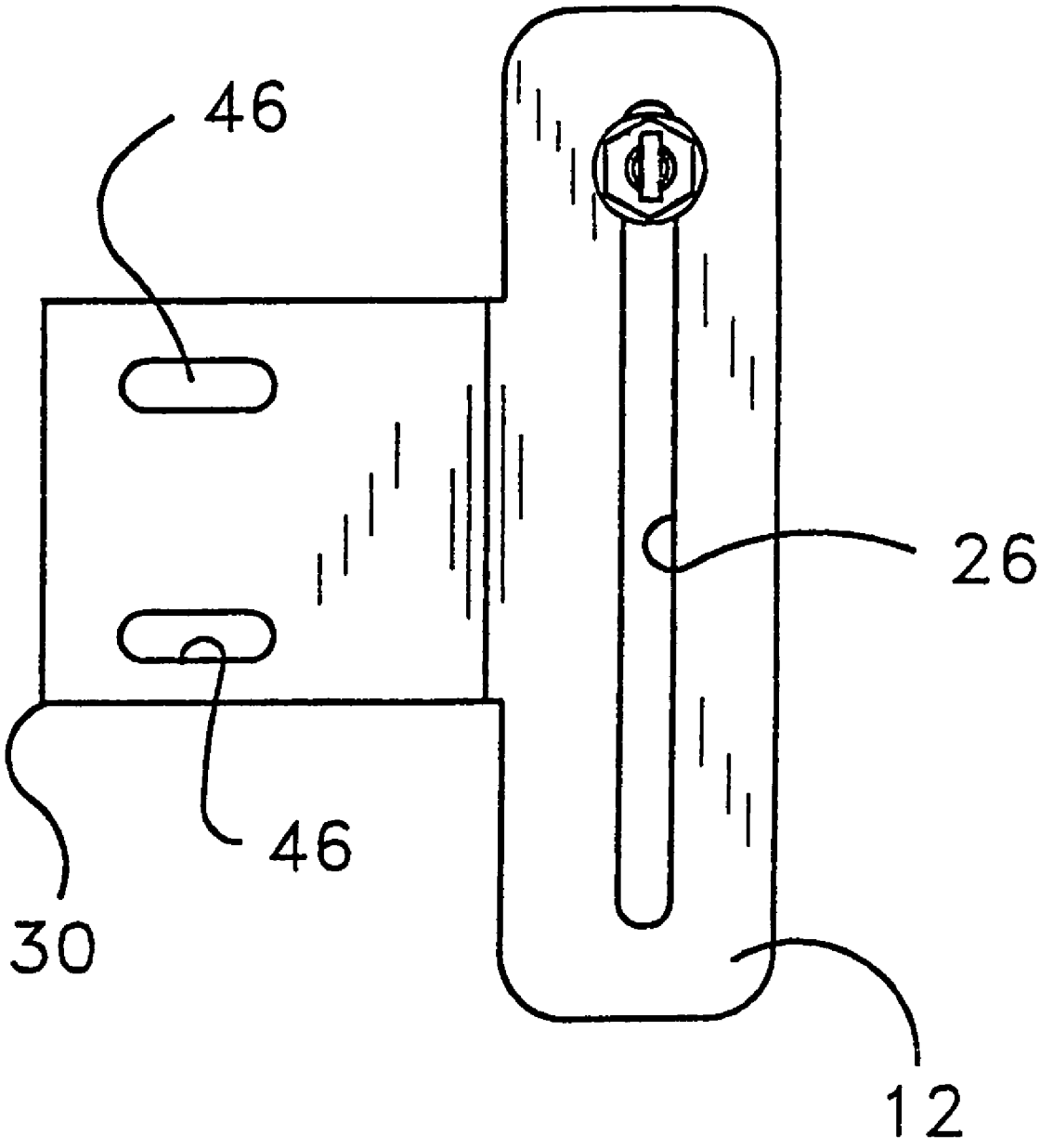
FIG. 4 is a side view of the first embodiment of the invention.

Referring now to FIG. 1, the bow sight system 10 of the present invention may be suitably used in combination with a pin sight assembly 1 that is mounted on a forward portion of a bow 2. A string 3 is mounted on the bow 2 at a location rearward of the bow 2 toward the user when the user is holding the bow for use. The pin sight assembly 1 can have one or several pins 4 that define a point in space forward of the bow 2. A rest 6 can support an arrow 7 having a direction of flight indicated by dashed lines 8.

In a first embodiment of the invention, illustrated in FIGS. 1-4, the bow sight system 10 generally comprises a first plate 12 having a first side 14 a second side 16, a top edge 18 a bottom edge 20 a first side edge 22 and a second side edge 24. An elongated slot 26 extends through the first plate 12 and generally extends between the top edge 18 and the bottom edge 20 that can be 3-4 inches.

A second plate 30 can have a first side 32, a second side 34, a top edge 36, a bottom edge 38, a first side edge 40 and a second side edge 42. The second plate 30 has a ninety-degree bend 44 therein extending between the top edge 36 and the bottom edge 38 and positioned nearer the second side edge 42 than the first side edge 40 of the second plate 30. The second side edge 42 of the second plate 30 is integrally formed with the first edge 22 of the first plate 12 at a generally perpendicular angle such that the first plate 12 lies in a plane oriented generally parallel to a plane of the second plate 30. The first plate 12 extends in an opposite direction to the second plate 30. A pair of apertures 46 extend through the second plate 30. The apertures 46 are spaced from one another. Each of the aperture 46 is elongated in a direction perpendicular to an axis through slot 26. Fasteners (not shown) can extend through apertures 46 to secure the bow sight system 10 to a bow 2 which commonly have threaded holes corresponding to the spacing of apertures 46. The elongated nature of the apertures 46 allows the device to be selectively moved on the bow 2 to optimize the distance of a sight 50 from the pins sight assembly 1 while preventing interference with the bow string 3. The aperture 46 will also allow for differences in hole spacing on different bows 2 to which the system 10 might be retrofit.

A sight 50 is positioned in and movable along the elongated slot 26. The sight 50 can comprise an elongated threaded member 52 having a first end 54 and a second end 56. The elongated member 52 can extend through the slot 26. A pair of securing members 58 are threadably coupled to the elongated member 52 for removably securing the elongated member 52 to the first plate 12. The first plate 12 is secured between the securing members 58 each of which can be a nut. A disc 60 is attached to the first end 54 of the elongated member 52. The disc lies in a plane oriented perpendicular to the plane of the first plate and perpendicular to a fine defining the direction of arrow flight to a target not shown. The disc 60 has an edge with a V-shaped groove 62 therein. Alternatively, the disc 60 may have a rectangular shape, or other geometrical shapes in place of the round shape. Of importance is the V-shaped groove 62 which is used for sighting purposes.

Figure 5:
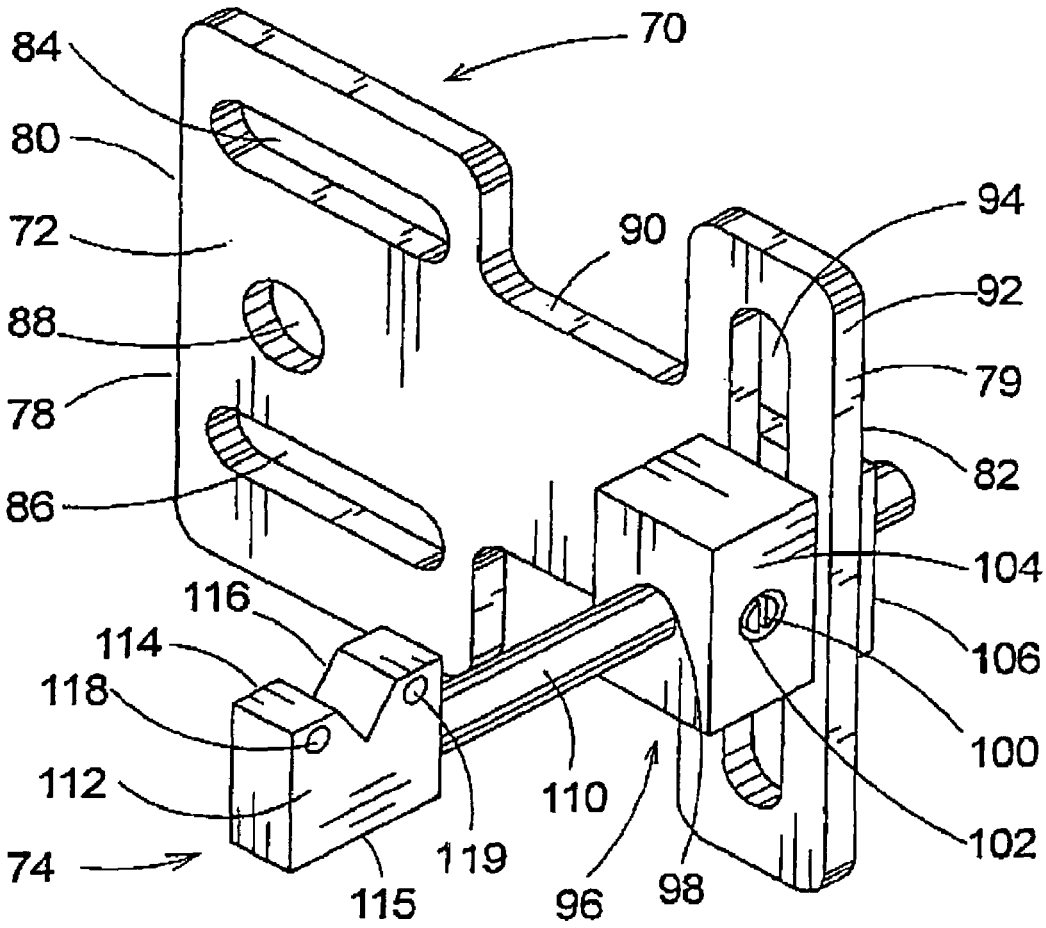
FIG. 5 is a perspective view of a second embodiment of the invention.
Figure 6:
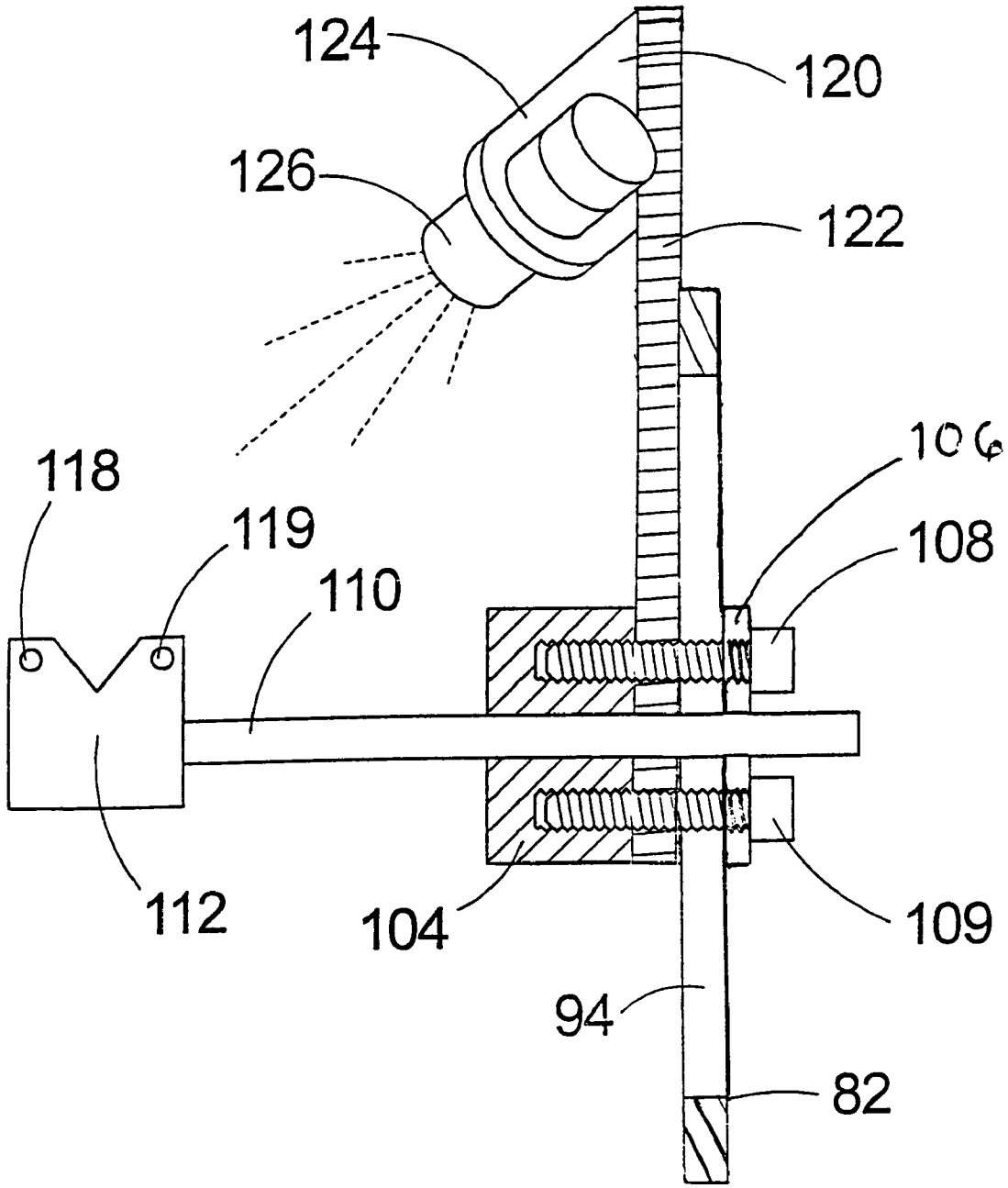
FIG. 6 shows additional details of the embodiment of FIG. 5.

A second embodiment is shown in FIGS. 5 and 6 and can best be understood with reference to FIG. 1. A bow sight 70 includes a base plate 72, a sighting assembly 74, and optionally a light assembly 120. The base plate 72 can be mounted on the bow 3 and has a front 78 and a rear 79. The base plate 72 may have a mounting portion 80 and a support portion 82 that extends from the mounting portion 80. The mounting portion 80 and support portion 82 can be substantially coplanar. The base plate 72 may be elongated in a longitudinal direction and have a longitudinal axis extending in the longitudinal direction of the base plate 72. The mounting portion 80 may include a first mounting slot 84 for receiving a fastener (not shown) for mounting the base plate 72 to the bow 3, and may include a second mounting slot 86 for receiving a second fastener (not shown) for mounting the base plate 72 to the bow 3. The first and second mounting slots may be substantially parallel. The mounting portion 80 may also have a mounting aperture 88, which may be located between the first 84 and second 86 mounting slots.

The support portion 82 may comprise a neck portion 90 and an adjustment section 92. The neck section 92 of the support portion may be mounted on the mounting portion 80, and the neck section 92 may extend outwardly from the mounting portion 80. The adjustment section 92 may be oriented substantially transverse to a longitudinal axis of the neck section 90. The support portion 82 may include a support slot 94, which may be located on the adjustment section 92. The support slot 94 may be oriented substantially perpendicular to the first 84 and second 86 mounting slots.

The sighting assembly 74 may guide the aiming of the bow 3 by eye of the user of the invention such as by correcting the body alignment with the bow 3. The sighting assembly 74 may be mounted on the base plate 72 in a manner that permits adjustable movement of the sighting assembly 74 on the base plate 72. The sighting assembly 74 may be adjustably movable on and with respect to the base plate 72 in directions that are perpendicular to the longitudinal axis of the base plate 72. The sighting assembly 74 may also be movable in a plane that is oriented perpendicular to the longitudinal axis of the base plate to permit adjustment of the orientation of the sight in a vertical direction when the invention is mounted on a bow 3.

The sighting assembly 74 may include a pedestal 96 that is slidably mounted on the base plate 72. The pedestal 96 may have a channel 98 formed therein, and the channel 98 may extend substantially perpendicular to a plane defined by the base plate 72. A set screw set hole 100 may be formed in the pedestal 96 and may be in communication with the channel 98, and a set screw 102 may be positioned in the set screw hole 100 such that rotation of the set screw 102 in a first direction moves the set screw 102 inwardly with respect to the pedestal 96.

The pedestal 96 may include an anchor member 104 that is positioned adjacent to the base plate 72. The channel 98 may be formed in the anchor member 104 in a location that is opposite of the base plate 72. The pedestal 96 may also include a backing plate 106 that is positioned on a side of the base plate 72 at a location that is opposite of the anchor member 104. The pedestal 96 may also include at least one fastener, and preferably includes a pair of fasteners 108, 109. The channel 98 may extend through the anchor member 104 and through the backing plate 106.

The sighting assembly 74 may also include a mast member 110 that is mounted on the pedestal 96. An end portion of the mast member 110 may be positioned in the channel 98 of the pedestal 96. A position of the mast member 110 in the channel 98 may be adjustable along an axis that extends substantially perpendicular to the plane of the base plate 72. The set screw 102 may be selectively abbuttable against the end portion of the mast member 110 that is positioned in the channel 98 for securing a position of the mast member 110 with respect to the pedestal 96.

The sighting assembly 74 may also include a sight guide 112 that is mounted on the mast member 110, and the sight guide may have a top 114 for orienting upwardly and a bottom 115 for orienting downwardly when the invention is mounted on a bow 3. The sight guide 112 may include a sight groove 116 that is formed therein, and the sight groove may have a substantial V-shaped cross section to form a V shaped notch. The sight groove 116 may extend from the top 114 of the sight guide 112 toward the bottom 115 of the sight guide 112. The thickness of the sight groove, from front to back should be sufficient to assure that the user's view through the groove is substantially parallel to the plane of the support portion of the base plate 72. If the bow 3 is turned relative to the user about a vertical axis, the user will not be able to see the pin of the pin sight 1. (See FIG. 9 and detailed description of FIG. 9).

The sight guide 112 may also include a pair of alignment marks 118, 119 that are marked on the sight guide 112. Each alignment mark 118, 119 may comprise a dot and the dots may be located on opposite sides of the sight groove 116. The alignment dots 118, 119 may be located adjacent to the top 114 of the sight guide 112 and can be painted with highly reflective or florescent paint or the alignment dots 118, 119 can be lighted fiber optics to aid the user in seeing them even in low light conditions.

FIG. 6 also shows that a light assembly 120 can be mounted on the base plate 72 for illuminating the alignment marks 118, 119 on the sight guide 112 as well as the V notch groove 116. The light assembly 120 is mounted on the base plate 72. The light assembly 120 may have a first bracket portion 122 and a second bracket portion 124.

The first bracket portion 122 may be positioned adjacent to the base plate 72 and the second bracket portion 124 may extend from the first bracket portion 122. The second bracket portion 124 includes a light 126. The light 126 can be battery powered and can operate at a frequency that will not distract the archer and yet one that will cause the alignment marks 118, 119 to glow visibly.

Figure 7:
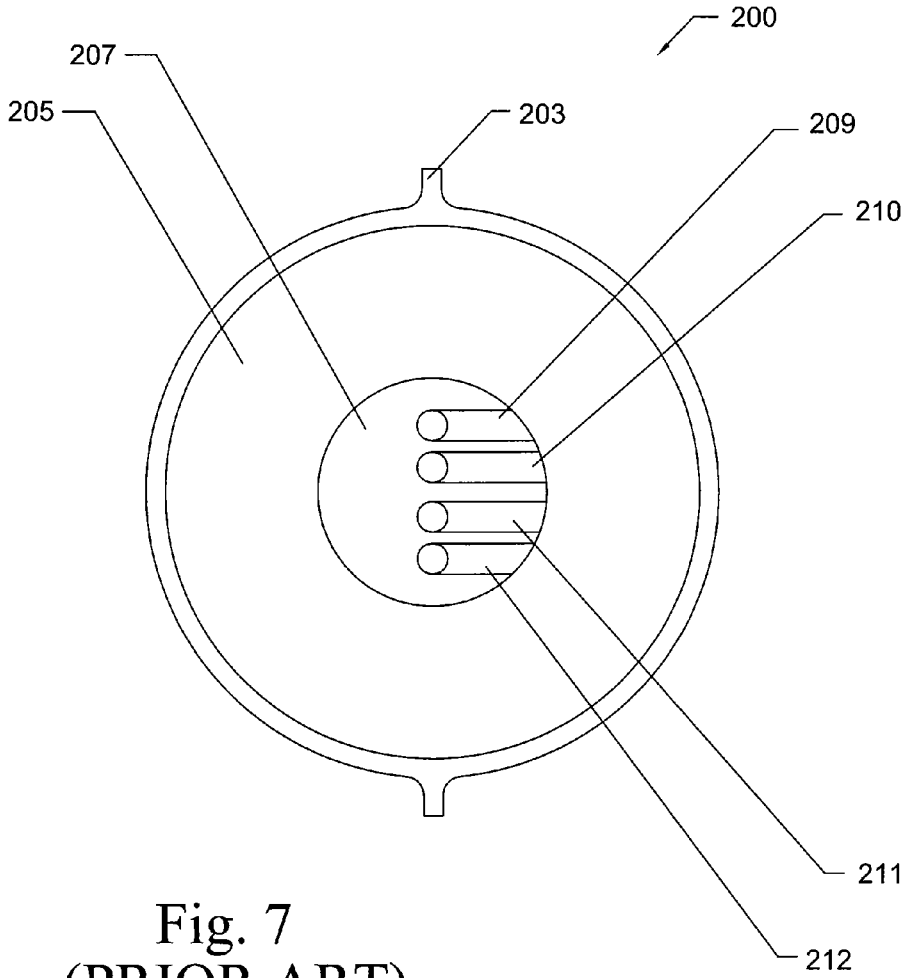
Fig. 7 (PRIOR ART)
FIG. 7 shows a view of the pin sights as seen with the prior art.

FIG. 7 shows a view of the pin sights 209 through the central hole 207 of a prior art peep sight 200. The prior art peep sight 200 is typically mounted in the bow string 203 and can include a line (not shown) that anchors to the bow 2 such that when the bow string 203 is drawn back into a firing position the peep sight will be forced into a position as shown where the pin sights are visible. Without the bow string 203 drawn the peep sight 200 is not aligned such that the pin sights 209 are visible through the central hole 207. Also when looking through the peep sight 200 the central hole is typically surrounded by the body portion 205 of the peep sight 200 which obscures the vision of the archer to all but what is visible through the central hole 207. The central hole 207 provides a field of view of about 10 degrees, large enough to see all the pin sights 209, 210, 211 and 212. Often there are 4 different colored pin sights each for targeting a different distance, the position of each pin is typically set by the archer based on their particular experience and on the power of the bow. Seeing all 4 pins 209, 210, 211 and 212 at once clutters the field of view through the central hole 207 and can slow the targeting process as the archer must think through the distance and use the appropriate pin. Experience has also shown that the lines, not shown, are usually small diameter rubber hose and easily get bumped off so that the peep sight does not work. Many archers do not use the peep sight because of the problems described, relying instead on an anchor point. The anchor point involves muscle memory and the ability of the archer to bring the bow 2 back to exactly the same point, the anchor point, such that the archers eye, head, arm and body are in exactly the same relationship with the bow 2 such that the archer can sight the bow 2 merely by setting the appropriate range pin on the target and releasing the arrow. This method of archery has the advantage of speed to release and avoids the problems with the peep sight, but also limits the accuracy of the shot that can be obtained to the limit of muscle memory of the archer.

Figure 8A:
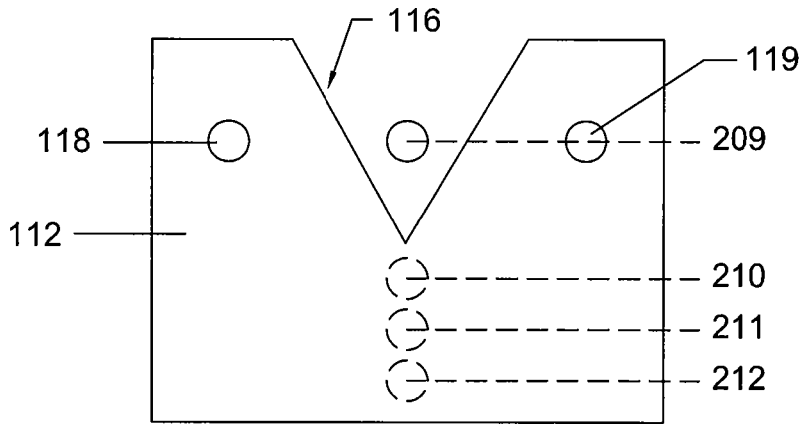
FIGS. 8*a, b* and *c* shows details of the appearance of the pin sights as seen with the present invention embodiment of FIG. 5 or 10.
Figure 8B:
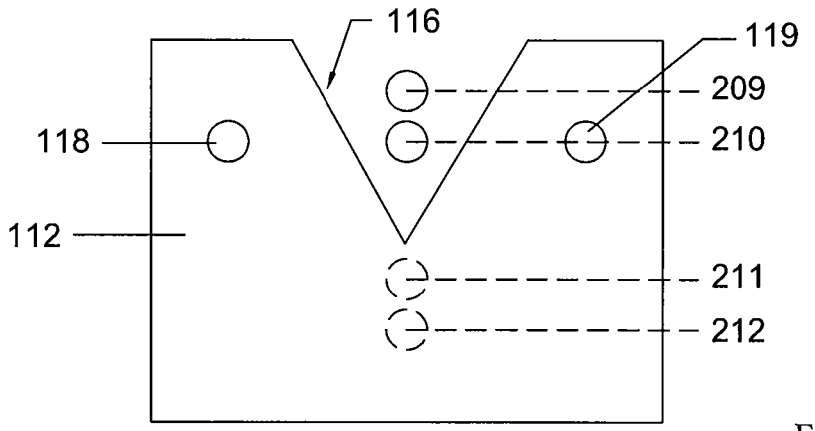
Figure 8C:
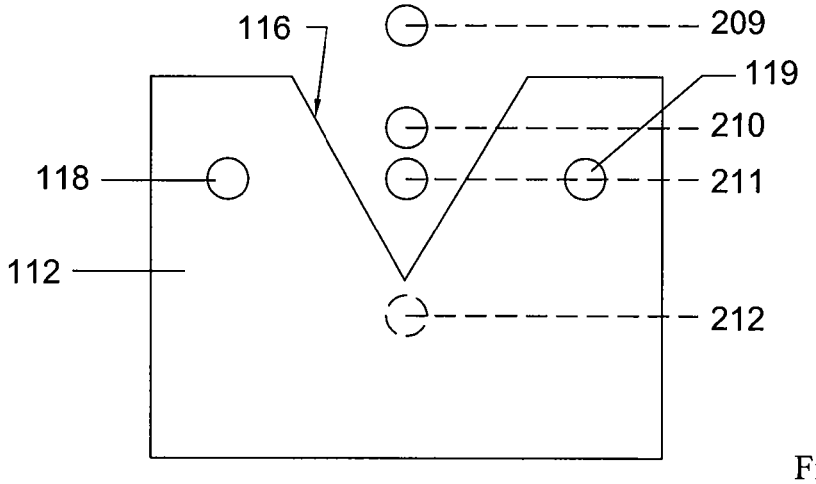

FIGS. 8*a*, 8*b* and 8*c* detail another advantage of the present invention. FIG. 8*a* shows the view of the pin sights 209, 210, 211 and 212 and archer would have using the sight guide 112 and groove 116 with a ten yard shot. Pin 209 is centered in the V notch groove 116 and aligned horizontally with the alignment marks 118 and 119. Seeing only one pin tells the archer he is aligned for making a ten-yard shot. As can be seen the archer has a relatively uncluttered field of view and has an unlimited size field above the sight groove 112. This unlimited field allows the archer to acquire the pin, target and alignment very quickly . . . like a rifle sight . . . just point and shoot.

FIG. 8*b* shows the arrangement for a twenty-yard shot, 2 pins visible tells the archer he is aligning a 20 yard shot. Similarily FIG. 8*c* shows three pins for a thirty-yard shot. Though the archer has an unlimited field of view, the archer also has reference points, the V groove 116 and alignment marks 118 and 119 that help the archer align the bow 2 and find the target. In the prior art the target and pins are floating and only muscle memory will help the archer. With the present invention the archer has more to guide than just muscle memory. An anchor point will still help the archer using the present invention, but its effectiveness is less dependent upon muscle memory and it will correct a poorly aligned shot by preventing the archer from seeing a pin if the bow 2 is misaligned.

Figure 9:
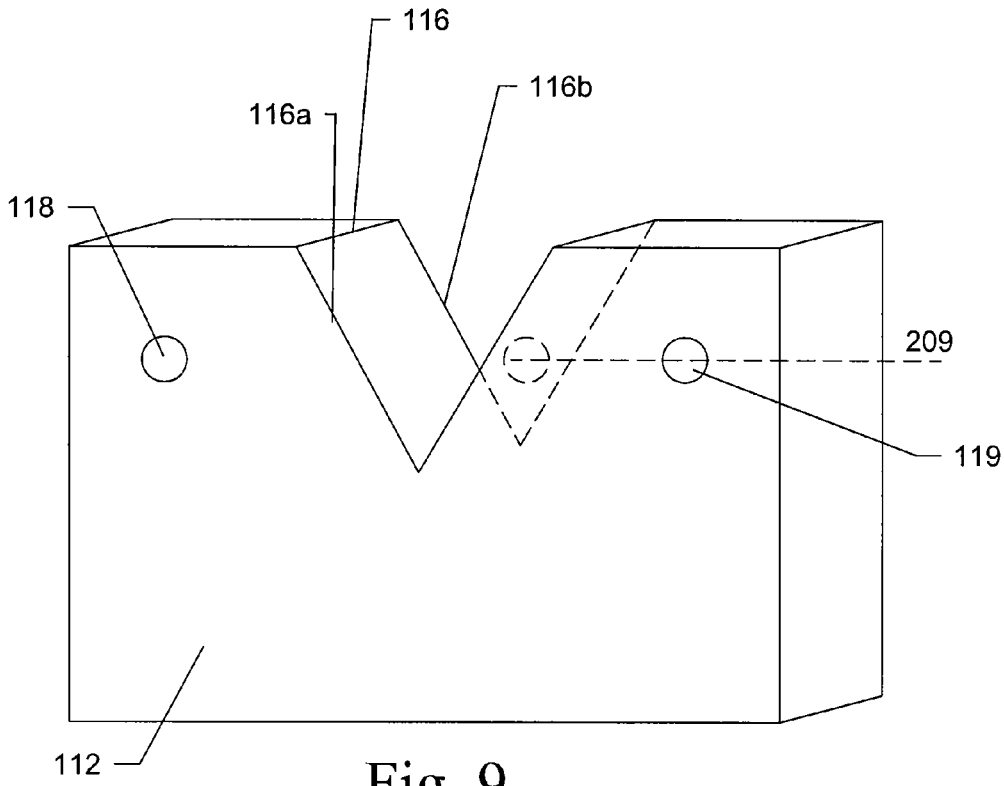
FIG. 9 shows a portion of the embodiment of FIG. 5 or 10.

FIG. 9 shows the view an archer would have using the present invention if the bow 2 or some aspect of the archers body is misaligned. In this case the archer's eye is to the right of perfect alignment with the groove 116. Bow 2 position or the archers head position could cause this condition. With the prior art the archer could have made the shot and even thought the pin 209 could have been right on target the shot would have gone to the right of target. But with the present invention the archer is warned that the shot is misaligned because the pin 209 is obscured. Note that the pin 209 is in the back V 116*b* but to the right of the front V 116*a* of the groove, this is how the thickness or distance between the front 116*a* and back 116*b* V assures the accuracy of the shot If the guide 112 were thin it would not have this property. Experience has shown that a thickness of about inch is very effective for the sight guide 112.

Figure 10:
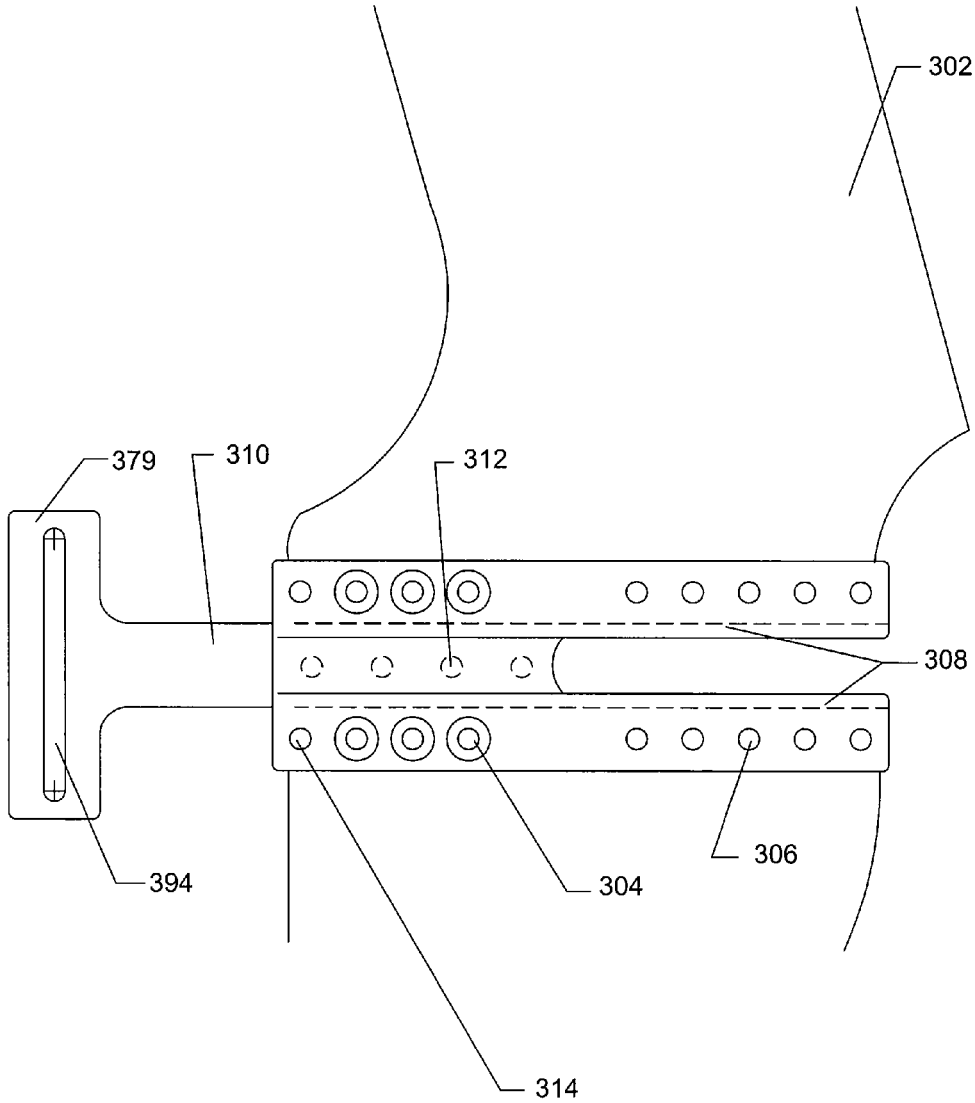
FIG. 10 shows a third embodiment of the present invention mounted on a bow.
Figure 11:
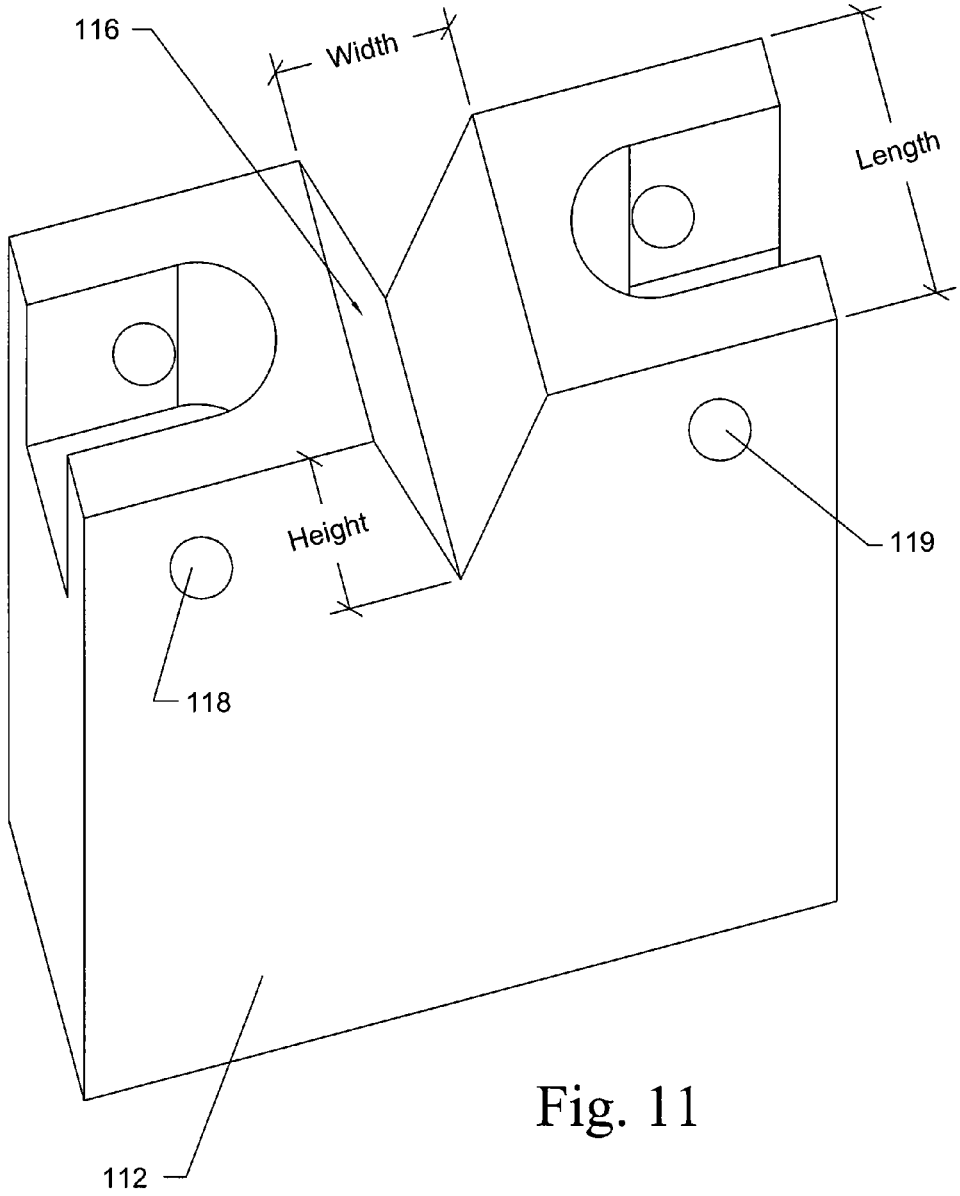
FIG. 11 shows a perspective view of a sighting assembly of the present invention.
Figure 12A:
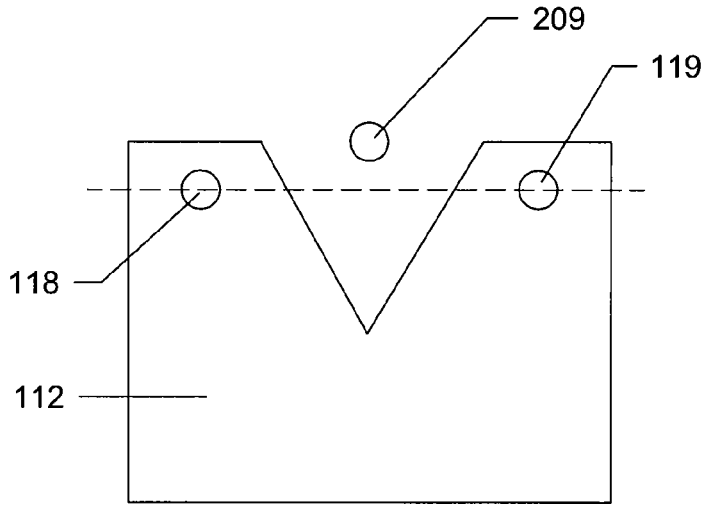
FIGS. 12*a* -12*c* illustrate front views of a sight guide of the sighting assembly.
Figure 12B:
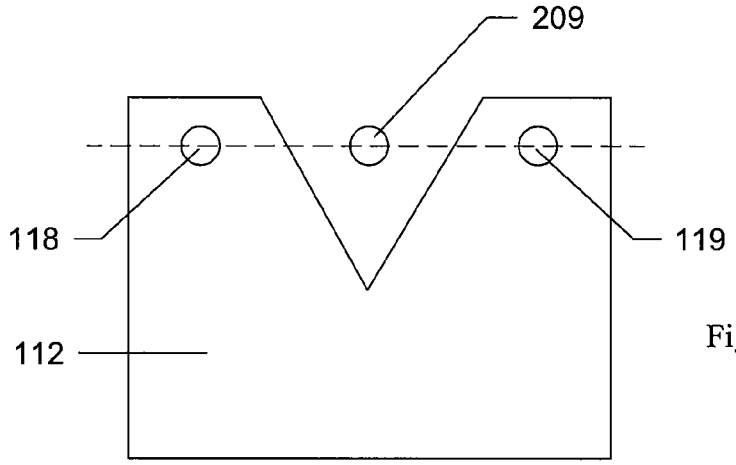
Figure 12C:
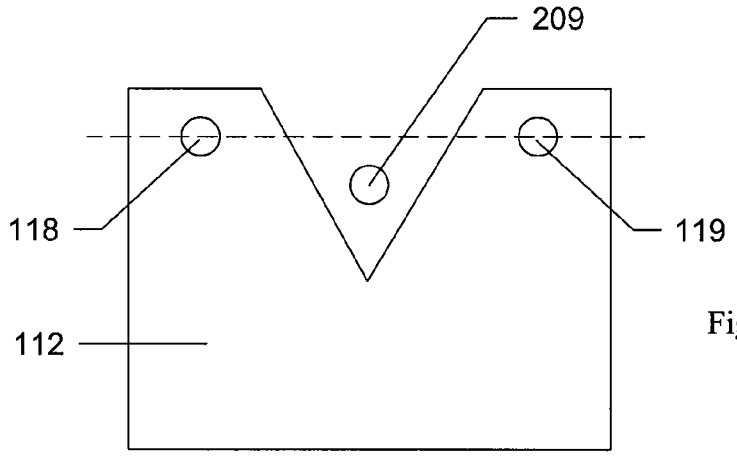

FIG. 10 shows details of a third embodiment of the present invention. This embodiment uses the same sighting assembly 74 as the second embodiment of FIG. 5 but is mounted to the bow 302 using bolts 304. Holes 306 can be used to mount a pin sight assembly 1. Adjust of the third embodiment comes from a slider 310 mounted in a slot 308. A set screw 312 can be used to lock the slide 310 in place relative to the slot 308. The slider 310 can carry a mounting plate 379 with a slot 394 that can provide an adjustable mounting for the sighting assembly 74 shown in the embodiment of FIG. 5. The embodiment of FIG. 10 shows a complete arrangement as might be used on new bows 302 manufactured with the rifle sight as original equipment. Such a bow is likely to include arrangements for mounting a quiver of arrows and for mounting the pin sights. Holes 314 can be used to mount a quiver of arrows (not shown). Slot 394 in plate 379 will support the mast member 110 and sighting assembly 74 as shown in the embodiment of FIG. 6.

In use, the device is generally used in conjunction with a sight mounted forwardly on the bow 2 such as pin sight 1. The bow sight assembly of the present invention is attached to a bow 2 in a position rearward of the bow 2 toward the user. The sight is positioned and adjusted to suit the archer and the characteristics of the bow such as size and poundage of draw. The archer then lines up the V groove 116 of the sight assembly 74 with the appropriate pin 209 as shown in FIG. 8*a* for a ten yard shot. The archer then visually sets the pin on the target and releases an arrow. In general the greater the thickness of the sight guide 112 and the greater the distance between the groove 116 and the pin sight 1 the greater will be the accuracy of the arrangement. The embodiment of FIG. 10 can give the archer more range to adjust the distance between the groove 116 and the pin sight 1.

The invention claimed is:

1. An improved rear sighting system for use in conjunction with a forward pin sight assembly on a bow, the improvement comprising;

a base plate for mounting on said bow, said base plate having a mounting portion and a support portion extending from said mounting portion, said base plate being elongated in a longitudinal direction and having a longitudinal axis, said mounting portion having a slot in the longitudinal direction and said support portion having a slide outwardly extending toward said mounting portion, said slide being removably insertable within said slot such that said support portion is transversely movable from said mounting portion along said longitudinal direction; and a sighting assembly having a sight groove, said sight groove extending along an axis oriented substantially parallel to the plane of said support portion, said sighting assembly being mounted on said base plate in a manner so that said sighting assembly is adjustably movable along three axis of movement relative to said base plate, said sight groove having a length, a width and a height such that said length has a longer dimension than said width, said height and said width of said sight groove being uniform along said length of said sight groove wherein said length is along the longitudinal axis that is parallel to flight of an arrow, said sight groove positioning said length such that misalignment of said bow will cause a portion of said sight groove to obscure a view through said sight groove.

2. The improved rear sighting system of claim 1 additionally comprising a bow string mounted thereon, said sighting assembly being mounted on said bow in a position rearward of said bow toward said string for orienting toward an archer when the archer draws said bow string of said bow.

3. The improved rear sighting system of claim 1 wherein said sighting assembly is mounted to said base plate along an axis that is substantially perpendicular to the plane of said support portion to permit adjustment of said position of said sight groove of said sighting assembly in a horizontal direction, said sighting assembly is further mounted to said base plate in a plane that is oriented substantially perpendicular to said longitudinal axis to permit adjustments of said sight groove in a vertical direction and said sighting assembly is further mounted to said base plate along said longitudinal axis to permit adjustment of said position of said sight groove of said sighting assembly in a transverse direction relative to said mounting portion to adjust the distance between said sight groove and said forward pin sight assembly.

4. The improved rear sighting system of claim 1 wherein the sighting assembly comprises:

a pedestal slidably mounted on said base plate and having a channel formed therein;

a mast member mounted on said pedestal with an end portion of said mast member being positioned in said channel of said pedestal such that a position of said mast member in the channel is adjustable, said sight groove being mounted on said mast member.

5. The improved rear sighting system of claim 4 wherein said sight groove has a substantially V-shaped cross section, said sight groove being located near a top edge of a sight guide such that said sight guide will obscure the archer's view below said V-shaped cross section.

6. The improved rear sighting system of claim 5 additionally comprising a pair of alignment marks on said sight guide, each of said alignment marks being located on an opposite side of said sight groove and located between a top of said height of said sight groove and a bottom of said height of said sight groove such that a first pin of said forward pin sight will form a line with said alignments marks when said bow is in a proper position and said first pin will be obscured when said bow is not in a proper position groove and wherein at least a second pin of said forward pin sight will be obscured by a portion of said rear sight below said sight groove.

7. The improved rear sighting system of claim 6 additionally comprising a light assembly being positioned to light said alignment marks such that said alignment marks will be visible in low light conditions.

8. The improved rear sighting system of claim 1 wherein said base plate is separately movable with said forward pin sight assembly.

9. A rear sight system for improving aiming of an arrow fired by a bow which has a base plate and a forward sight, the rear sight system, comprising:

a rear sight mounted on said base plate such that said rear sight is adjustably movable along three axis of movement relative to said base plate, said rear sight having a sight groove that is free from interferences along a length of said sight groove, said rear sight being separately movable from said forward sight in a direction substantially parallel to a direction of flight of said arrow fired by said bow, said rear sight including a pair of alignment marks, located near a middle portion of said rear sight, that align with a pin on said forward sight only when said bow is properly aligned such that said pin is located away from said rear sight and wherein said pin is obscured when said bow is misaligned.

10. The rear sight of claim 9 wherein said rear sight has a V-shape such that an archer can sight said forward sight through the V-shape.

11. The rear sight of claim 9 wherein said rear sight is a groove having a front edge visible to an archer and a rear edge, a distance from said front edge to said rear edge defining a thickness of said rear sight such that a misalignment of an eye of the archer relative to said rear sight will obscure the archer's view of said forward sight through said rear sight.

12. The rear sight of claim 11 wherein said groove has a V-shaped cross section and wherein said forward sight is a pin sight.

13. The rear sight of claim 12 wherein said alignment marks are on either side of said groove.

14. The rear sight of claim 13 including a light mounted for movement with said bow sight assembly, said light illuminating said alignment marks.

15. A rear sight for use in conjunction with a pin sight on a bow, the rear sight, comprising;

a base plate for mounting on said bow, said base plate being elongated in a longitudinal direction and having a longitudinal axis parallel to flight of an arrow;

a sighting assembly mounted on said base plate in a manner such that said sighting assembly is adjustably movable with respect to said base plate along three axis of movement, said sighting assembly configured to be separately mounted on said bow at a distance from said pin sight and wherein said sighting assembly includes a block with a sight groove having a length, a width and a height such that said length has a longer dimension than said width, said height and said width of said sight groove being uniform along said length of said sight groove wherein said length is along the longitudinal axis, said length being in a direction such that an archer's view through said groove will be obscured by the block if said groove is turned.

16. The rear sight of claim 15 wherein said groove is a V-notch.

17. The rear sight of claim 15 including an alignment mark on each side of said groove that form a linear pattern with a pin on said pin sight when said bow is properly aligned.

18. The rear sight of claim 17 including a light to illuminate said alignment mark on each side of said groove such that said alignment marks are visible in low light conditions.

19. A rear sight for use in conjunction with a pin sight on a bow, said rear sight, comprising;

a sighting groove mounted on a base plate of said bow, said sighting groove being adjustably moveable along three axis of movement with respect to said bow such that an archer can sight through said sighting groove at said pin sight only when said bow and archer are properly aligned, said sighting groove having a length, width and a height such that said length has a longer dimension than said width, said height and said width of said sight groove being uniform along said length of said sight groove wherein said length is along a longitudinal axis that is parallel to flight of an arrow, such that misalignment of the bow will cause a portion of said groove to obscure a view through said groove.

20. The rear sight of claim 19 wherein said sighting groove is fixed relative to said bow and separate from said front sight and said sighting groove includes a pair of alignment marks on each side of said groove and located between a top of said height of said groove and a bottom of said height of said sight groove wherein said pin sight aligns with said alignment marks on said rear sight only when said bow is properly aligned.

21. A rear sight system for use in conjunction with a forward sight assembly positioned on a bow, the rear sight, comprising;

a base plate mounted to said bow, said base plate having a mounting portion for being removably attached on said bow and a support portion extending from said mounting portion, said base plate being separately movable connected to said bow with respect to said forward sight assembly; and a sighting assembly having a sight groove, said sight groove extending along an axis oriented substantially parallel to said support portion, said sighting assembly being mounted on said base plate in a manner so that said sight groove is adjustably movable along three axis of movement relative to said base plate, said sight groove having a length, a width and a height such that said length has a longer dimension than said width, said height and said width of said sight groove being uniform along said length of said sight groove wherein said length is along a longitudinal axis that is parallel to flight of an arrow, said sight groove positioning said length such that misalignment of said bow will cause a portion of said sight groove to obscure a view through said sight groove.

22. The rear sight of claim 21 wherein said mounting portion has a slot in a longitudinal direction and said support portion has a slide outwardly extending toward said mounting portion, said slide being removably insertable within said slot such that said support portion is transversely movable from said mounting portion along said longitudinal direction.

23. The rear sight of claim 21 wherein said forward sight is moveable along said longitudinal direction.

* * * * *